US006786688B2

(12) United States Patent
Wang

(10) Patent No.: US 6,786,688 B2
(45) Date of Patent: Sep. 7, 2004

(54) BASE PLATE SUPPORT FOR ANTI-BLAST CARGO CONTAINER

(75) Inventor: Feng-Ho Wang, Hsinchu (TW)

(73) Assignee: Industrial Technologyy Research Institute, Hsinchu (TW)

( * ) Notice: Subject to any disclaimer, the term of this patent is extended or adjusted under 35 U.S.C. 154(b) by 53 days.

(21) Appl. No.: 10/170,899

(22) Filed: Jun. 12, 2002

(65) Prior Publication Data

US 2003/0231937 A1 Dec. 18, 2003

(51) Int. Cl.[7] ..... B61D 3/16
(52) U.S. Cl. ..... 410/46; 86/50; 403/279
(58) Field of Search ..... 410/46; 403/274, 403/279, 403, 382; 296/181, 182, 29; 86/49, 50; 220/1.5, 677, 88.1, 610, 615, 616

(56) References Cited

U.S. PATENT DOCUMENTS 4,676,038 A * 6/1987 Doyon et al. ..... 403/231
4,712,942 A * 12/1987 Brown ..... 403/174
4,840,440 A * 6/1989 Dieter ..... 403/402
5,538,178 A * 7/1996 Zink et al. ..... 229/117.01
5,769,257 A * 6/1998 Fleisher et al. ..... 220/1.5
6,089,398 A * 7/2000 Weinstein ..... 220/324
6,112,931 A * 9/2000 Booth et al. ..... 220/88.1
6,196,107 B1 * 3/2001 Hoffman et al. ..... 86/50
2003/0106414 A1 * 6/2003 Wang ..... 86/50

FOREIGN PATENT DOCUMENTS

JP 401254541 * 10/1989 ..... 229/198.2
SU 1406055 * 6/1988

* cited by examiner

*Primary Examiner*—Dennis H. Pedder
*Assistant Examiner*—Hilary Gutman
(74) *Attorney, Agent, or Firm*—Pro-Techtor International Services

(57) ABSTRACT

A base plate support for a container, comprising a main body, horizontal fastening plate, and at least one vertical fastening plate. The main body has a tube-like structure extended along a longitudinal direction and an upper side which is by a gap divided into two half-plates. A connecting plate bridges the gap inside the tube-like structure. The horizontal fastening plate extends from a lateral side of the main body for holding a base plate of a container. The vertical fastening plate extends from an upper side of the main body for holding a lateral wall plate of the container, continuing from one of the two half-plates. A force generated by a bomb blast flexibly deforms at least one of the two half-plates and is thus effectively absorbed.

3 Claims, 3 Drawing Sheets

BASE PLATE SUPPORT FOR ANTI-BLAST CARGO CONTAINER

BACKGROUND OF THE INVENTION

1. Field of the Invention

The present invention relates to a base plate support for a container, particularly to an energy absorbing base plate support connecting a base plate and a side wall of an anti-blast cargo container.

2. Description of Related Art

Due to an increasing number of terror attacks, security of commercial flights has received more and more attention. In recent years, bombs in flight baggage and cargo have become a security worry. Therefore, blast resistant containers are the topic of product research in every country.

Blast damage is largely different from damage due to static forces or shifting of load. During a blast, energy is released almost instantly. A rigid construction relying on high weight and material strength will not be able to resist a blast, rather a design for absorbing and converting of shock energy is required.

As shown in FIG. 5, a conventional base plate support for a flight cargo container mainly comprises: a main body 1, having a roughly trapezoidal cross-section; a horizontal fastening plate 2A, horizontally extending away from the main body 1 and connected with the base plate 17 of the container; and a vertical fastening plate 2B, vertically extending away from the main body 1 and connected with a lateral wall plate 3 of the container. The vertical fastening plate 2B further comprises a vertical lower section 4, a horizontal middle section 5 and a vertical upper section 6, thus being bent twice at right angles.

The lateral wall plate 3 of the container is fastened to the upper section 6 of the vertical fastening plate 2B. If a blast hits the container, the lateral wall plate 3 exerts an outward and upward directed force on the vertical fastening plate 2B. Then the middle section 5 and the lower and upper sections 4, 6 undergo torque in different directions. Thus a strong blast will deform the vertical fastening plate 2B and damage the container.

Even if due to flexibility of the base plate support the effect of a blast is spread out in time, torque on the vertical fastening plate 2B is not reduced.

Referring to FIG. 6, in another design a conventional base plate support for a flight cargo container mainly comprises: a main body 7, having a roughly trapezoidal cross-section; a horizontal fastening plate 8A, horizontally extending away from the main body 1 and connected with the base plate 17 of the container; and a vertical fastening plate 8B, vertically extending away from the main body 1 and connected with the lateral wall plate 3 of the container. The vertical fastening plate 8B is an unbent plate without a horizontal section, thus having less flexibility. Therefore, upon a blast, rigid behavior is shown, without any absorbing effect.

As above examples show, a conventional base plate support for a flight cargo container offers no protection against a blast. Reinforcing containers by adding material, on the other hand, increases weight, which is a great disadvantage.

SUMMARY OF THE INVENTION

It is the main object of the present invention to provide a base plate support for a container which is able to absorb a bomb blast.

Another object of the present invention is to provide a base plate support for a container which, having a reinforced structure, is effective against a bomb blast.

The present invention can be more fully understood by reference to the following description and accompanying drawings.

DETAILED DESCRIPTION OF THE PREFERRED EMBODIMENTS

Figure 1:
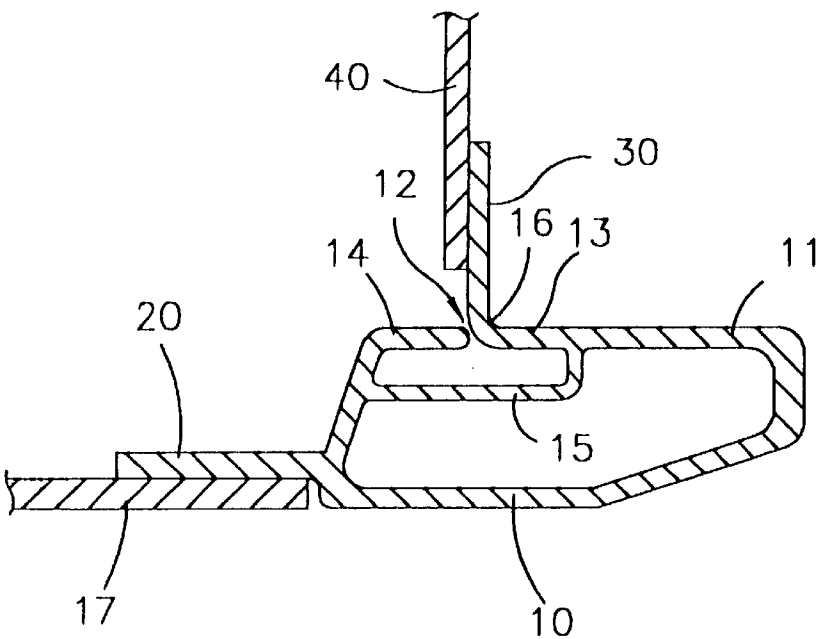
FIG. 1 is a cross-sectional view of the base plate support for a container of the present invention in the first embodiment.

As shown in FIG. 1, the base plate support for a container of the present invention in a first embodiment mainly comprises: a main body 10; a horizontal fastening plate 20; and a vertical fastening plate 30. The main body 10 is a tube-like body, extending along a longitudinal axis, having a lower side to which the horizontal fastening plate 20 is attached and an upper part 11 to which the vertical fastening plate 30 is attached. The main body 10, the horizontal fastening plate 20 and the vertical fastening plate 30 are made by pressing aluminum sheets.

The main characteristic of the present invention lies in that the upper part 11 of the main body 10 has a gap 12 along the longitudinal direction. Thus the upper plate 11 is divided into an outer half-plate 13 and an inner half-plate 14, which are unconnected. The inner half-plate 14 has an edge close to the outer half-plate 13. The outer half-plate 13 has an edge to which the vertical fastening plate 30 is fastened. Alternatively, the edge of the inner half-plate 14 is free, and the vertical fastening plate 30 is fastened to the edge of the outer half-plate 13. A connecting plate 15, bridging the gap 12 from below, connects the outer half-plate 13 and the inner half-plate 14. Deforming the connecting plate 15 does not impair the function of the container.

Figure 2:
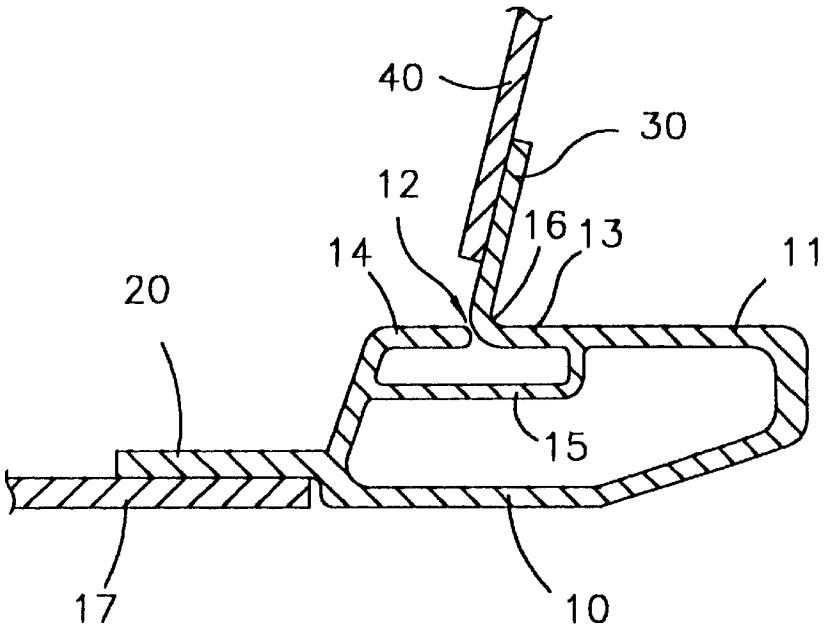
FIG. 2 is a cross-sectional view of the present invention in the first embodiment after deformation due to a blast.

Referring to FIG. 2, the outer half-plate 13 and the vertical fastening plate 30 are continuations of each other, with a bent section 16 lying in between. Since the outer half-plate 13 and the inner half-plate 14 of the upper part 11 are not connected, the outer half-plate 13, when subjected to a force on the vertical fastening plate 30 due to a bomb blast, is deformed without being restricted by the inner half-plate 14, thus being able to accommodate a large force, with no overly large torque developing.

At the moment of a blast, the outer half-plate 13 and the inner half-plate 14 separate, flexibly absorbing shock energy. Furthermore, the connecting plate 15 partly transmits any load between the outer and inner half-plates 13, 14, so that stability is high while weight is low.

The present invention not only provides effective shock absorption and resistance against a bomb blast, but also high stability under regular load, improving on the shortcomings of conventional base plate supports for containers.

Figure 3:
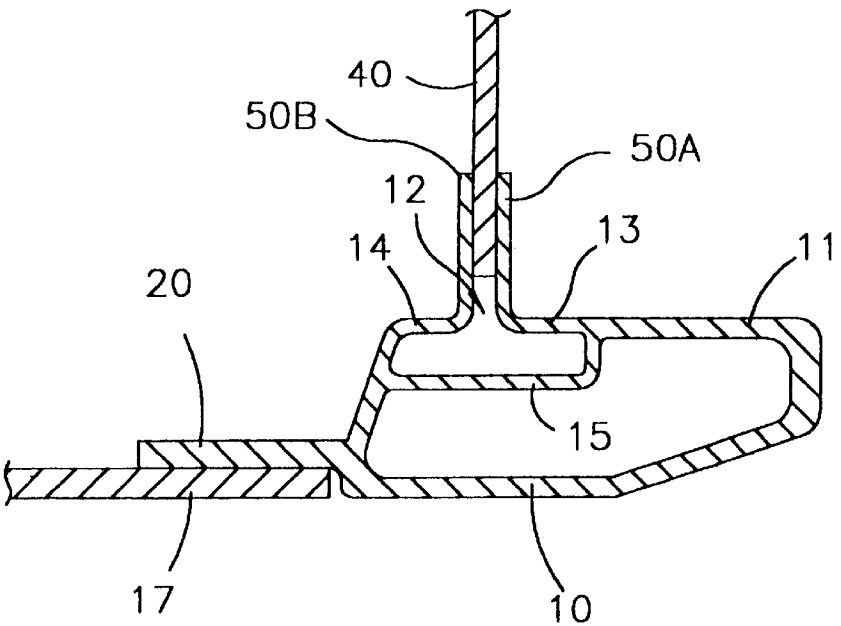
FIG. 3 is a cross-sectional view of the base plate support for a container of the present invention in the second embodiment.
Figure 5:
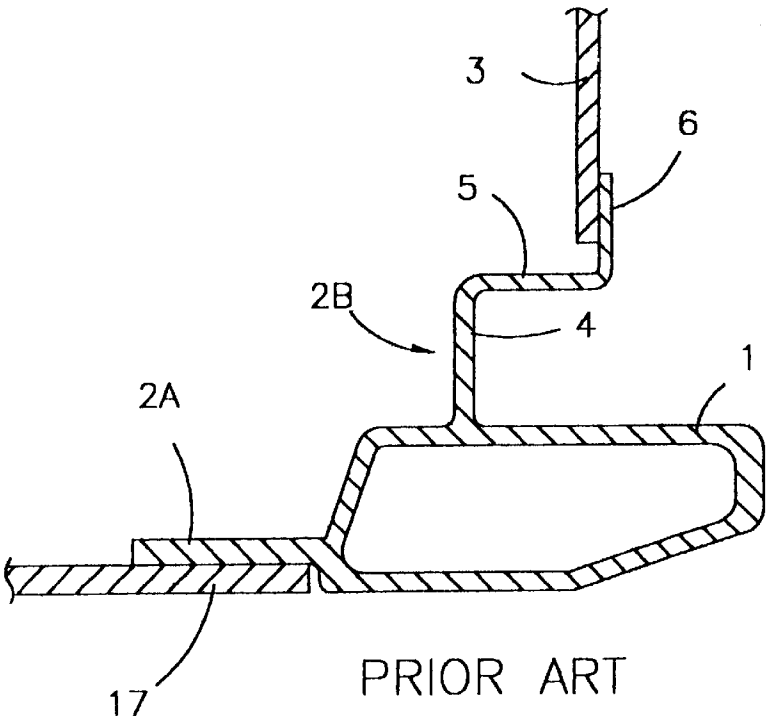
PRIOR ART FIG. 5
FIG. 5 is a cross-sectional view of a conventional base plate support for a container.
Figure 6:
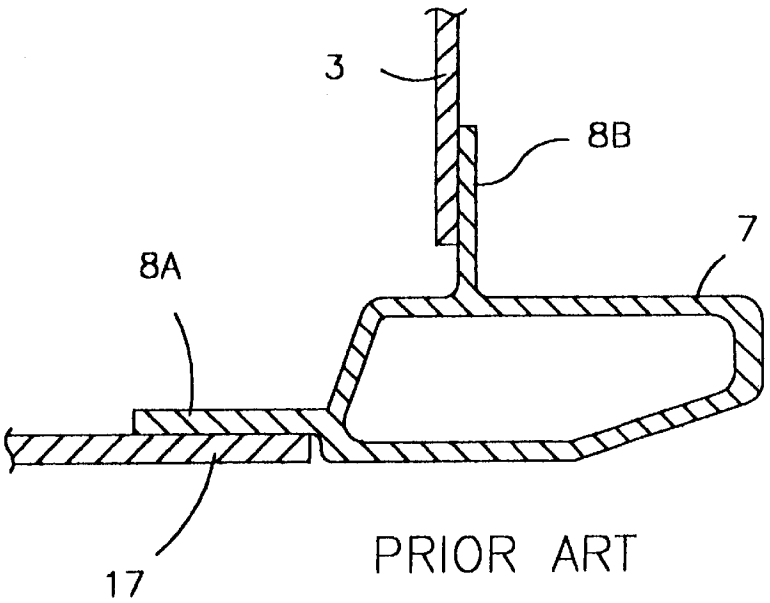
PRIOR ART FIG. 6
FIG. 6 is a cross-sectional view of a conventional base plate support for a container in another design.

In the first embodiment, the present invention has a vertical fastening plate consisting of a single sheet. When fastened to a lateral wall plate 40 of a container, an additional pressure plate or padding is required for a tight connection. The present invention in a second embodiment improves on this shortcoming. As shown in FIG. 3, the present invention in the second embodiment has the main body 10 and the horizontal fastening plate 20 connected as in the first embodiment. The upper part 11 is by the gap 12 divided into the outer half-plate 13 and the inner half-plate 14.

Different from the first embodiment, however, the second embodiment has two vertical fastening plates 50A, 50B, continuing from the outer half-plate 13 and the inner half-plate 14, respectively. The lateral wall plate 40 of the container is inserted between the vertical fastening plates 50A, 50B and held thereby.

Figure 4:
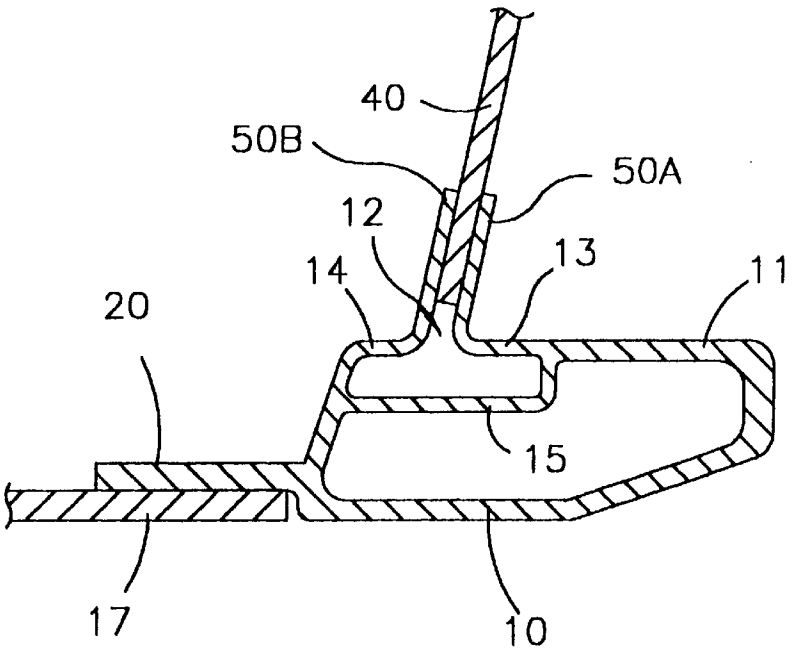
FIG. 4 is a cross-sectional view of the present invention in the second embodiment after deformation due to a blast.

Referring to FIG. 4, when a bomb blast exerts a force on the lateral wall plate 40, the outer and inner half-plates 13, 14 deform flexibly, effectively accommodating the blast. Under normal conditions, stability is improved, since the lateral wall plate 40 is supported on both sides by the vertical fastening plates 50A, 50B.

Furthermore, when mounting the lateral wall plate 40, due to support on both sides thereof by the vertical fastening plates 50A, 50B, no additional pressing plate or padding is required, simplifying assembly.

While the invention has been described with reference to preferred embodiments thereof, it is to be understood that modifications or variations may be easily made without departing from the spirit of this invention which is defined by the appended claims.

What is claimed is:

1. A base plate support for a container comprising:

a tube-like main body with an upper side having a longitudinal gap therein, said gap dividing said main body into two half-plates, with a connecting plate bridging said gap inside said tube-like main body, a horizontal fastening plate extending from a lateral side of said main body to secure a base plate of the container, and at least one vertical fastening plate extending from the upper side of said main body to secure a lateral wall plate of said container, said vertical fastening plate extending from an edge of at least one of said two half-plates; wherein a force generated by a bomb blast flexibly deforms at least one of said two half-plates and is thus effectively absorbed.

2. A base plate support for a container according to claim 1, wherein:

said vertical fastening plate and a first one of said half-plates are connected by a bent section that contacts an edge of a second one of said half-plates, so that under regular load, said bent section is supported by said edge of said second half-plate.

3. A base plate support for a container according to claim 1, wherein:

said vertical fastening plate comprises a pair of vertical plates which are parallel to each other, and wherein each of said pair of vertical plates extend from an edge of one of said two half-plates.

* * * * *